US008196918B2

(12) United States Patent
Arimura et al.

(10) Patent No.: US 8,196,918 B2
(45) Date of Patent: Jun. 12, 2012

(54) FEED ASSEMBLY AND IMAGE FORMING APPARATUS INCORPORATING FEED ASSEMBLY

(75) Inventors: Shingo Arimura, Osaka (JP); Mashio Takezawa, Osaka (JP)

(73) Assignee: Kyocera Mita Corporation (JP)

( * ) Notice: Subject to any disclaimer, the term of this patent is extended or adjusted under 35 U.S.C. 154(b) by 32 days.

(21) Appl. No.: 12/969,678

(22) Filed: Dec. 16, 2010

(65) Prior Publication Data

US 2011/0148028 A1 Jun. 23, 2011

(30) Foreign Application Priority Data

Dec. 22, 2009 (JP) ..... 2009-291094
May 25, 2010 (JP) ..... 2010-119669

(51) Int. Cl.
*B65H 3/52* (2006.01)

(52) U.S. Cl. ..... 271/124; 271/121; 271/167

(58) Field of Classification Search ..... 271/109, 271/121, 124, 167
See application file for complete search history.

(56) References Cited

U.S. PATENT DOCUMENTS 5,370,381 A * 12/1994 Winship et al. ..... 271/121
6,554,272 B2 * 4/2003 Otake et al. ..... 271/121
7,441,766 B2 * 10/2008 Seki et al. ..... 271/121

FOREIGN PATENT DOCUMENTS

JP 2000-296931 10/2000
JP 2009-40512 2/2009

* cited by examiner

*Primary Examiner* — Kaitlin Joerger
*Assistant Examiner* — Prasad Gokhale
(74) *Attorney, Agent, or Firm* — Gerald E. Hespos; Michael J. Porco

(57) ABSTRACT

A feed assembly including: feed roller; support element for supporting feed roller; separating mechanism for facilitating separation of first and second sheets; and base with guide surface for guiding sheets and positioning wall for positioning separating mechanism; wherein engaging portion for engaging with separating mechanism is formed in positioning wall; separating mechanism includes: separator for separating sheets; first biasing element including first and second ends; seat including first and second walls; positioning element installed on first wall to be moved between first and second positions; and shifter for shifting positioning element; first biasing element biases separator; shifter holds positioning element in first position; and when feed roller is removed from support element, shifter moves positioning element to second position.

8 Claims, 16 Drawing Sheets

FEED ASSEMBLY AND IMAGE FORMING APPARATUS INCORPORATING FEED ASSEMBLY

BACKGROUND OF THE INVENTION

1. Field of the Invention

The present invention relates to a feed assembly and an image forming apparatus incorporating the feed assembly.

2. Description of the Related Art

Image forming apparatuses such as copiers, printers, facsimile machines or composite machines with their functions typically include a feed assembly configured to pick up a sheet one by one from a pile of stacked sheets to convey the sheet to an image forming portion. The feed assembly typically includes a feed roller abutting against an upper surface of the sheet pile and a pad confronting the feed roller. If the feed roller rotates to send out sheets from the sheet pile, the pad applies a frictional force to the sheets other than the uppermost sheet to prevent conveyance of excessive sheets.

As described above, the feed roller and the pad are configured to convey sheets one after another using a frictional force caused between themselves and the sheets, and therefore it is inevitable that the roller and the pad is worn out. A worn feed roller and/or a worn pad cause defective sheet feed. Therefore, when the defective sheet feed occurs, a well-experienced operator replaces the feed roller and/or the pad.

An improved image forming apparatus comprises a structure configured to allow a feed roller to be more easily removed. Consequently, a user may replace the feed roller without assistance of an experienced operator.

The improved image forming apparatus described above includes the structure allowing the feed roller to be easily removed but does not comprise a structure configured to allow a separating pad to be easily removed or accurately installed. Consequently, if defective sheet feed arises from wear of the separating pad, the experienced operator has to replace the separating pad and/or the feed roller.

The problem described above arises not only with the separating pad, but is also common in other elements configured to separate sheets with a frictional force on the sheets.

SUMMARY OF THE INVENTION

It is an object of the present invention to provide a feed assembly configured to allow easier replacement of a separating mechanism even for a person other than an experienced operator, and an image forming apparatus incorporating the feed assembly.

A feed assembly for feeding a sheet including a first sheet and a second sheet following the first sheet according to one aspect of the present invention includes: a feed roller configured to convey the sheet; a support element configured to detachably and rotatably support the feed roller; a separating mechanism configured to separate the second sheet from the first sheet when the second sheet is conveyed and overlapped with the first sheet; and a base including a guide surface configured to guide the sheet and a positioning wall configured to position the separating mechanism; wherein an engaging portion configured to engage with the separating mechanism is formed in the positioning wall; and the separating mechanism includes: a separator configured to cause a resistance force against conveyance of the sheet by the feed roller to separate the second sheet from the first sheet when the second sheet is conveyed and overlapped with the first sheet; a first biasing element including a first end connected to the separator and a second end opposite to the first end; a seat including a first wall confronting the positioning wall and a second wall connected to the second end of the first biasing element; a positioning element installed on the first wall so that the positioning element moves between a first position where the positioning element is engaged with the engaging portion and a second position where the positioning element is disengaged from the engaging portion; and a shifter configured to shift the positioning element between the first position and the second position; the first biasing element biases the separator apart from the second wall; the shifter holds the positioning element in the first position while the support element supports the feed roller; and when the feed roller is removed from the support element, the first biasing element projects the separator from the guide surface while the shifter shifts the positioning element to the second position.

An image forming apparatus for forming an image on a sheet including a first sheet and a second sheet following the first sheet according to another aspect of the present invention includes: a feed assembly configured to feed the sheet; and an image forming portion configured to form the image on the sheet conveyed from the feed assembly; wherein the feed assembly includes: a feed roller configured to convey the sheet; a support element configured to detachably and rotatably support the feed roller; a separating mechanism configured to separate the second sheet from the first sheet when the second sheet is conveyed and overlapped with the first sheet; and a base including a guide surface configured to guide the sheet and a positioning wall configured to position the separating mechanism; an engaging portion configured to engage with the separating mechanism is formed in the positioning wall; the separating mechanism includes: a separator configured to cause a resistance force against conveyance of the sheet by the feed roller to separate the second sheet from the first sheet when the second sheet is conveyed and overlapped with the first sheet; a first biasing element including a first end connected to the separator and a second end opposite to the first end; a seat including a first wall confronting the positioning wall and a second wall connected to the second end of the first biasing element; a positioning element installed on the first wall moves between a first position where the positioning element is engaged with the engaging portion and a second position where the positioning element is disengaged from the engaging portion; and a shifter configured to shift the positioning element between the first position and the second position; the first biasing element biases the separator apart from the second wall; the shifter holds the positioning element in the first position while the support element supports the feed roller; and when the feed roller is removed from the support element, the first biasing element projects the separator from the guide surface while the shifter shifts the positioning element to the second position.

DETAILED DESCRIPTION OF THE PREFERRED EMBODIMENTS

Hereinafter various embodiments of the feed assembly and the image forming apparatus are described with reference to the accompanying drawings. Directional terms such as "upper", "lower", "left", "right" and the like herein are simply used to clarify the following description and should not be in any way restrictively interpreted. Furthermore, in the description below, a term "sheet" means copying paper, coated paper, an OHP sheet, thick paper, postcard, tracing paper or any other sheet material to be subjected to an image forming process. Terms "upstream", "downstream" and the like used in the following description mean "upstream", "downstream" and similar concepts in respect of the sheet conveyance direction.

(First Embodiment)

(Image Forming Apparatus)

Figure 1:
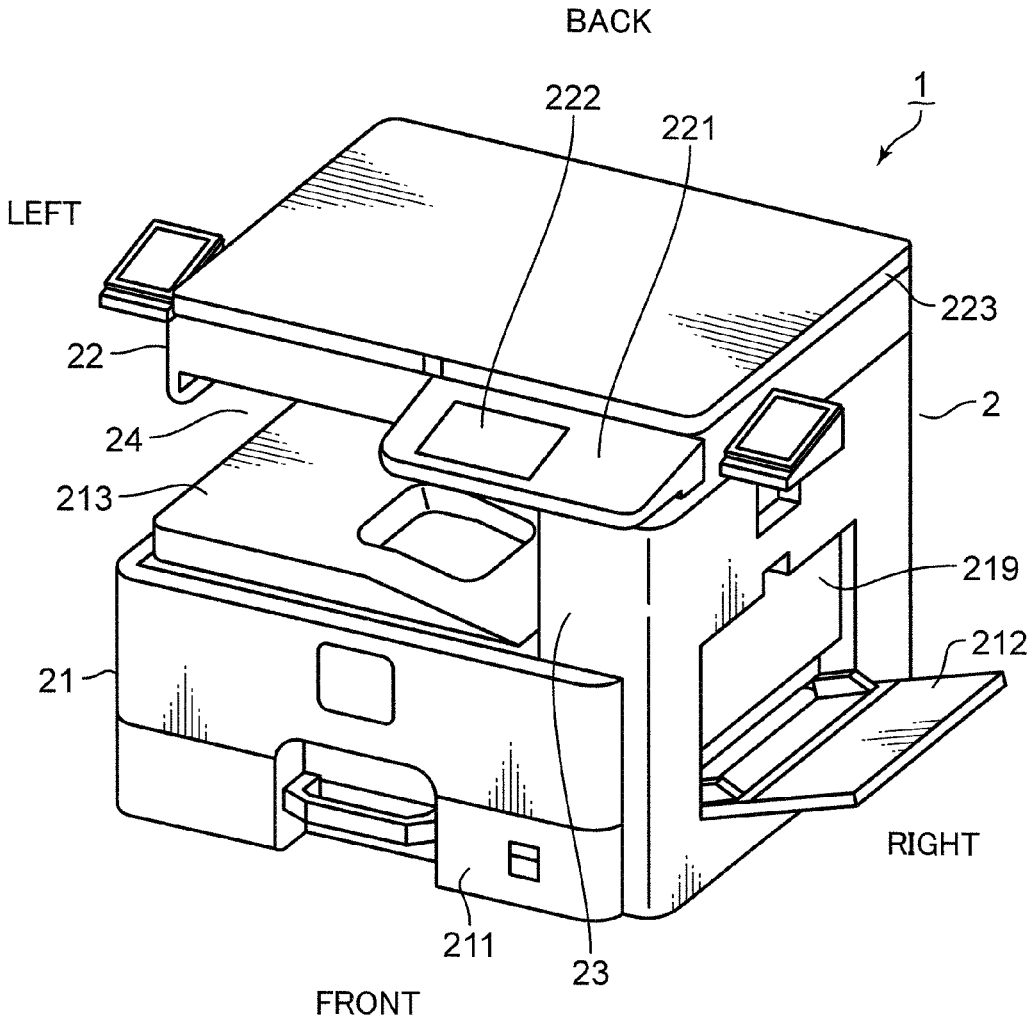
FIG. 1 is a perspective view of an image forming apparatus according to a first embodiment.

FIG. 1 is a perspective view of the image forming apparatus according to the first embodiment. The image forming apparatus shown in FIG. 1 is a so-called in-house discharge type of a copying machine. Alternatively, the image forming apparatus may also be a printer, a facsimile machine, a composite machine with their functions or another apparatus configured to form a toner image on a sheet.

The copying machine 1 includes a substantially rectangular parallelepiped housing 2. The housing 2 includes a substantially rectangular parallelepiped lower housing 21, a substantially rectangular parallelepiped upper housing 22 disposed above the lower housing 21 and a connecting housing 23 configured to connects the lower housing 21 with the upper housing 22. The connecting housing 23 extends along a right edge and a rear edge of the housing 2. A sheet subjected to printing processes is discharged to a discharge space 24 surrounded by the lower housing 21, the upper housing 22 and the connecting housing 23.

An operating portion 221 projecting in a front direction of the upper housing 22 may include, for example, an LCD touch panel 222. The operating portion 221 is configured to receive input of information relating to image formation processes. A user may input information such as a number of sheets to be printed and print density, for example, via the LCD touch panel 222. The upper housing 22 principally accommodates a device configured to read a document image and an electronic circuit configured to entirely control operation of the copying machine 1.

A pressing cover 223 arranged over the upper housing 22 is used to press down a document. The pressing cover 223 is installed so as to vertically rotate on the upper housing 22. The user may rotate the pressing cover 223 upwards to place a document on the upper housing 22. Thereupon, the user operates the operating portion 221 to read in an image of the document by a document reading device inside the upper housing 22.

A cassette 211 configured to accommodate sheets is fitted into the lower housing 21. The cassette 211 may be pulled out towards a front side of the lower housing 21. A sheet accommodated in the cassette is subjected to an image formation process in the lower housing 21 on the basis of an instruction input by the user via the operating portion 221 and is then discharged to the discharge space 24.

A tray 212 is rotatably attached on a right surface of the lower housing 21. The user may place a sheet on the tray 212 projecting rightward from the lower housing 21. The sheet on the tray 212 is pulled into the lower housing 21 to be subjected to the image formation process on the basis of an instruction input by the user via the operating portion 221 and then is discharged to the discharge space 24. When the tray 212 is rotated upwards, the tray 212 is accommodated inside an accommodation recess 219 provided in the right surface of the lower housing 21 to close off a feeding inlet for introducing sheets into the lower housing 21.

The lower housing 21 accommodates various devices configured to form an image on the sheet. Furthermore, the connecting housing 23 accommodates various devices configured to discharge the sheet after the image formation process to the discharge space 24.

Figure 2:
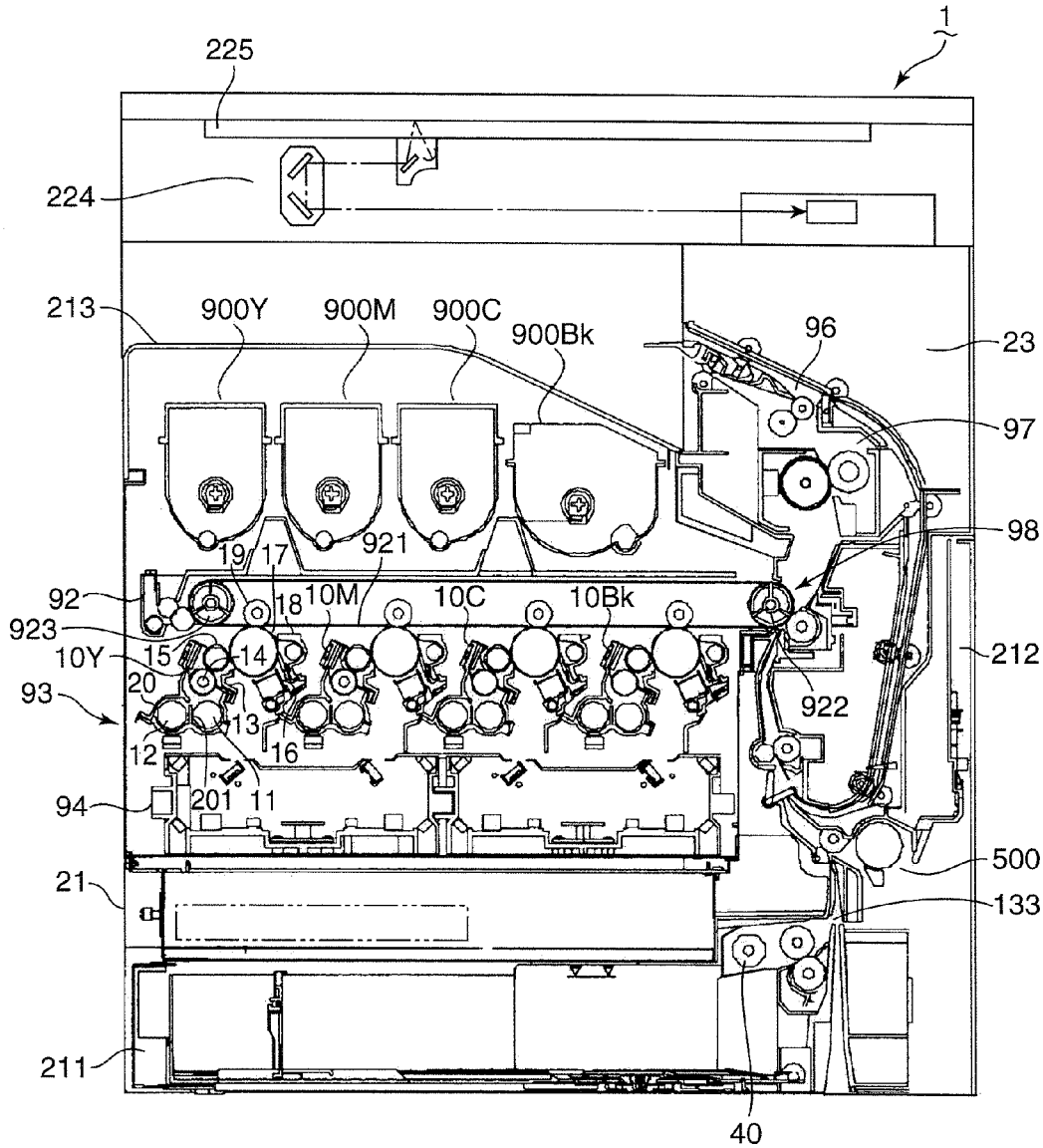
FIG. 2 is a schematic view of an internal configuration of the image forming apparatus shown in FIG. 1.

FIG. 2 shows a schematic view of an internal configuration of the copying machine 1 shown in FIG. 1. The copying machine 1 is further described hereinafter with reference to FIGS. 1 and 2.

The upper housing 22 accommodates a scanning mechanism 224. A user may read an image of a desired document into the copying machine 1 by using the scanning mechanism 224. A contact glass 225 on an upper surface of the upper housing 22 is disposed above the scanning mechanism 224. The pressing cover 223 is used to press the document placed on the contact glass 225. When the user operates the operating portion 221 to activate the copying machine 1, the scanning mechanism 224 scans and reads an image of the document on the contact glass 225. Analogue information of the image read by the scanning mechanism 224 is converted into digital signals. The copying machine 1 forms an image on a sheet on the basis of the digital signals.

The lower housing 21 comprises toner containers 900Y, 900M, 900C, 900Bk, an intermediate transfer unit 92, an image forming portion 93, an exposure unit 94, a fixing unit 97 and a discharge unit 96.

The image forming portion 93 comprises a toner container 900Y configured to accommodate yellow toner, a toner container 900M configured to accommodate magenta toner, a toner container 900C configured to accommodate cyan toner and a toner container 900Bk configured to accommodate black toner. Developing apparatuses 10Y, 10M, 10C and 10Bk are provided below the toner containers 900Y, 900M, 900C and 900Bk, respectively. The developing apparatuses 10Y, 10M, 10C and 10Bk uses the yellow toner, the magenta toner, the cyan toner and the black toner, which are supplied from the toner containers 900Y, 900M, 900C and 900Bk, to carry out developing processes, respectively.

The image forming portion 93 includes photosensitive drums (photosensitive bodies on which a latent image is formed by an electrophotographic method) configured to bear toner images. A photosensitive drum with an amorphous silicon (a-Si) material may be preferably employed for the photosensitive drums 17. The yellow toner, magenta toner, cyan toner and black toner from the toner containers 900Y, 900M, 900C and 900Bk are applied to the photosensitive drums 17, respectively.

A charging device 16, the developing apparatus 10Y, 10M, 10C or 10Bk, a transfer roller 19 and a cleaning apparatus 18 are deployed around each of the photosensitive drums 17. The charging device 16 uniformly charges a circumferential surface of the photosensitive drum 17. The exposure unit 94 exposes the charged circumferential surface of the photosensitive drum 17 to form an electrostatic latent image. The exposure unit 94 irradiates laser light on the basis of the digital signals generated by the scanning mechanism 224 described above. The developing apparatuses 10Y, 10M, 10C and 10Bk use the toner supplied from the toner containers 900Y, 900M, 900C and 900Bk to develop (or visualize) the electrostatic latent images formed on the photosensitive drums 17, respectively. The transfer roller 19 and the photosensitive drum 17 grip the intermediate transfer belt 921 to form a nip section. The toner image on the photosensitive drum 17 is primarily transferred onto the intermediate transfer belt 921 passing through the nip section. The cleaning apparatus 18 wipes the circumferential surface of the photosensitive drum 17 after the primary transfer.

The developing apparatuses 10Y, 10M, 10C and 10Bk comprise a housing 20, respectively. Two-component developer containing magnetic carrier and toner is accommodated in the housing 20. Agitating rollers 11 and 12 extending in parallel to each other inside the housing 20 rotate near a bottom of the housing 20.

A circulation path of the developer is formed on an inner bottom surface of the housing 20. The agitating rollers 11 and 12 are disposed inside the circulation path. The housing 20 includes a partition 201 extending along the agitating rollers 11, 12. The partitioning wall 201 standing from the bottom of the housing 20 defines the circulation path, which surrounds the partition 201. The agitating rollers 11 and 12 agitate and convey the two-component developer along the circulation path.

The toner is charged during the agitation and the conveyance of the two-component developer. The two-component developer on the agitating roller 11 is attracted and conveyed to an upper magnetic roller 14. The attracted two-component developer forms a magnetic brush (not shown) on the magnetic roller 14. A doctor blade 13 restricts a thickness of the magnetic brush layer. A toner layer on the developing roller 15 is formed by a potential difference between the magnetic roller 14 and the developing roller 15. An electrostatic latent image on the photosensitive drum 17 is developed by the toner layer.

The exposure unit 94 including various optical elements such as a light source, a polygon mirror, a reflective mirror and a deflective mirror irradiates light based on image data to form an electrostatic latent image onto the circumferential surfaces of the photosensitive drums 17 provided in the image forming portion 93, respectively.

The intermediate transfer unit 92 comprises a drive roller 922 and an idle roller 923 in addition to the intermediate transfer belt 921 described above. Toner images are superimposed onto the intermediate transfer belt 921 from the photosensitive drums 17 (primary transfer). In a secondary transfer unit 98, the superimposed toner images are then secondarily transferred to a sheet fed from the cassette 211 or the tray 212 (see FIG. 1). The drive roller 922 and the idle roller 923 which work for running the intermediate transfer belt 921 are rotatably supported by the lower housing 21.

The fixing unit 97 carries out a fixing process for the toner image on the sheet after the secondary transfer from the intermediate transfer unit 92. The sheet bearing a color image after the fixing process is discharged toward the discharge unit 96 above the fixing unit 97 (inside the connecting housing 23).

The discharge unit 96 discharges the sheet conveyed from the fixing unit 97 onto an upper surface 213 of the lower housing 21, which is used as a discharge tray.

The cassette 211 accommodates a pile of stacked sheets. As described above, the cassette 211 is detachably installed in the lower housing 21. A pick-up roller 40 provided on the cassette 211 drives to pick and pull out the uppermost sheet of the sheet pile from the cassette 211 to a feed conveyance path 133 one after another. The sheet is then introduced into the image forming portion 93.

The tray 212 is disposed above the cassette 211. The tray 212 shown in FIG. 2 is located in a closed position where the feed inlet is closed. The tray 212 may be rotated rightwards about a rotational axis formed on a lower end of the tray 212 to support a pile of stacked sheets. A feed assembly 500 is disposed near the lower end of the tray 212. The feed assembly 500 pulls out the sheets placed on the tray 212 one by one to the image forming portion 93 which forms an image on the sheets.

(Feed Assembly)

Figure 3:
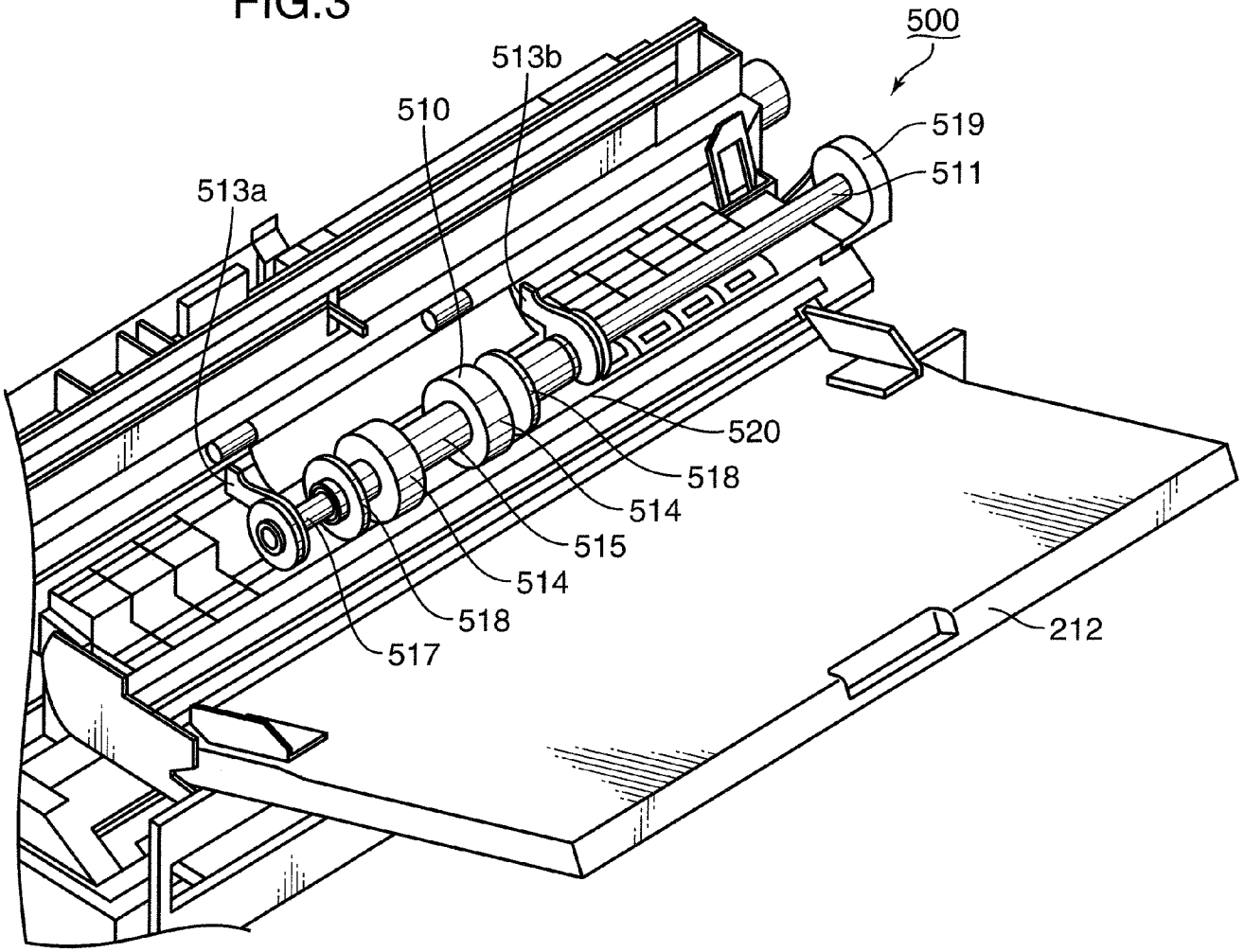
FIG. 3 is a perspective view of a feed assembly incorporated into the image forming apparatus shown in FIG. 1.
Figure 4:
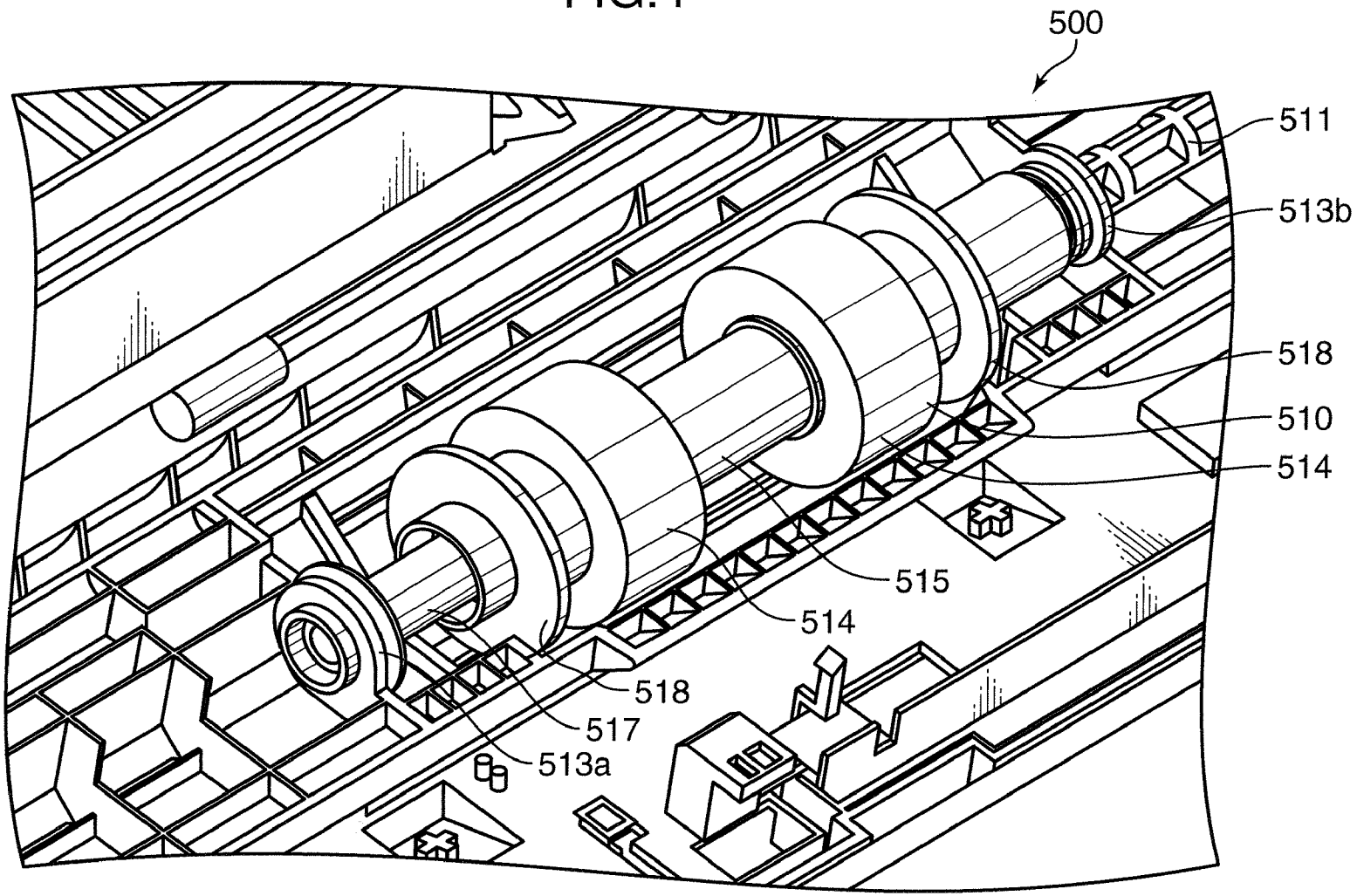
FIG. 4 is an enlarged perspective view of the feed assembly shown in FIG. 3.

FIG. 3 is a schematic perspective view of the feed assembly 500 appearing after downward rotation of the tray 212. FIG. 4 is an enlarged schematic perspective view around a feed roller shown in FIG. 3. The feed assembly 500 is described hereinafter with reference to FIGS. 2 to 4.

The feed assembly 500 comprises a feed roller 510 configured to convey a sheet placed on the tray 212. One end of the feed roller 510 is detachably connected to a drive shaft 511 while the other end thereof is detachably and rotatably connected to a first bracket 513*a*. The drive shaft 511 and/or the first bracket 513*a* are exemplified as a support element configured to detachably and rotatably support the feed roller 510.

The drive shaft 511 is rotatably supported by a second bracket 513*b*. The first bracket 513*a*, the feed roller 510 and the drive shaft 511 are arranged in a width direction of the sheet. The term "width direction of the sheet" means a direction substantially perpendicular to the sheet conveyance direction.

A gear is attached on an end of the drive shaft 511 (in FIG. 3, the gear is covered with a gear cover 519). The gear engages with a drive shaft of a drive source such as a motor (not shown). The feed roller 510 and the drive shaft 511 integrally rotate during operation of the drive source.

(Feed Roller)

Figure 5C:
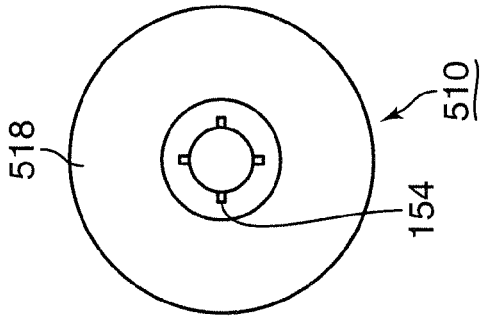
FIG. 5C is a schematic side view showing the feed roller of the feed assembly shown in FIG. 4.
Figure 5A:
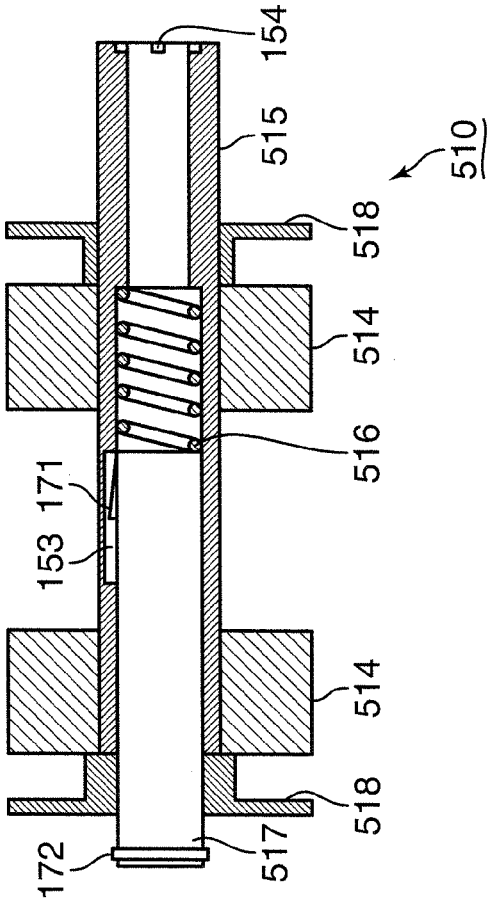
FIG. 5A is a schematic cross-sectional view showing a feed roller of the feed assembly shown in FIG. 4.
Figure 5B:
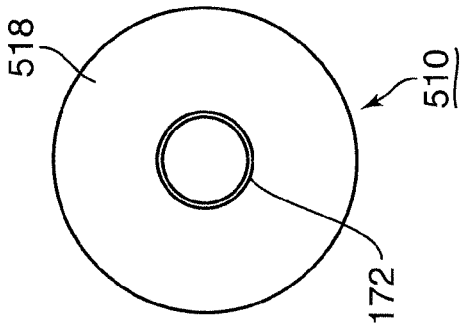
FIG. 5B is a schematic side view showing the feed roller of the feed assembly shown in FIG. 4.

FIG. 5A is a cross-sectional view of the feed roller 510. FIG. 5B is a side view of the feed roller 510 for showing a connecting portion with the first bracket 513*a*. FIG. 5C is a side view of the feed roller 510 for showing a connecting portion with the drive shaft 511. The feed roller 510 is described hereinafter with reference to FIGS. 3 to 5C.

The feed roller 510 comprises a pair of substantially cylindrical conveyance tubes 514 in contact with a sheet and a main shaft 515 inserted into the conveyance tubes 514. The main shaft 515 integrally rotates with the conveyance tubes 514. The feed roller 510 further comprises a coil spring 516 accommodated in the main shaft 515 and a substantially cylindrical subsidiary shaft 517 inserted into the main shaft 515. The coil spring 516 biases the subsidiary shaft 517 to the first bracket 513*a*. The feed roller 510 further comprises substantially ring knobs 518 adjacent to outer side surfaces of the conveyance tubes 514, respectively.

The conveyance tubes 514 are made of a material with a coefficient of friction high enough to convey a sheet (for example, a cork material). An engaging groove 153 extending in a longitudinal direction of the main shaft 515 is formed in an inner circumferential surface of the main shaft 515. Engaging grooves 154 are formed, for example, at a pitch of approximately 90° in an end surface of the main shaft 515 to be connected to the drive shaft 511. For example, complementary projections (not shown in FIG. 5A to FIG. 5C) disposed at a pitch of approximately 90° corresponding to the engaging grooves 154 are formed in an end surface of the drive shaft 511 to be connected to the end surface of the main shaft 515. As a result of engagement between the engaging grooves 154 and the projections of the drive shaft 511, rotation of the drive shaft 511 is transmitted to the main shaft 515. The conveyance tubes 514 and the main shaft 515 interlock so that a sufficient magnitude of frictional force works between the conveyance tubes 514 and an outer circumferential surface of the main shaft 515 to integrally rotate the main shaft 515 and the conveyance tubes 514. Alternatively, the conveyance tubes 514 and the main shaft 515 may be connected by means of a suitable fixing piece such as a set bolt. Consequently, the rotation transferred to the main shaft 515 is transmitted to the conveyance tubes 514.

After insertion of the coil spring 516 into the main shaft 515, the subsidiary shaft 517 is inserted into the main shaft 515. A substantially triangular projecting rib 171 is formed in an outer circumferential surface of the subsidiary shaft 517 inserted into the main shaft 515 near an end of the subsidiary shaft 517. A projection amount of the projecting rib 171 becomes smaller toward the end of the subsidiary shaft 517. The projecting rib 171 engages with the engaging groove 153 formed in the main shaft 515. Consequently, the rotation transferred to the main shaft 515 is transmitted to the subsidiary shaft 517.

An annular projection 172 is formed near an end of the subsidiary shaft 517 which is connected to the first bracket 513*a*. A portion between the projection 172 and the end of the subsidiary shaft 517 is rotatably supported by the first bracket 513*a*. The projecting rib 171 is stopped by an end of the engaging groove 153 when the subsidiary shaft 517 is in a projecting position where the coil spring 516 pushes out the subsidiary shaft 517 from the main shaft 515. Meanwhile, the projection 172 is apart from an end surface of the main shaft 515. A user may push the subsidiary shaft 517 into the main shaft 515 so that the projection 172 approaches the end surface of the main shaft 515.

The paired knobs 518 are used to connect the feed roller 510 with the drive shaft 511 as well as the first bracket 513*a*. The knob 518 beside the drive shaft 511 is connected to the main shaft 515. The knob 518 beside the first bracket 513*a* is connected to the subsidiary shaft 517. A user may grip the paired knobs 518 adjacent to the outer side surfaces of the paired conveyance tubes 514, respectively, and apply a force to move the knob 518 beside the first bracket 513*a* toward the knob 518 beside the drive shaft 511, so that the subsidiary shaft 517 is inserted into the main shaft 515. Thereupon, the user aligns the main shaft 515 with the drive shaft 511 and also aligns the subsidiary shaft 517 with the first bracket 513*a*, and then releases the force applied to the knobs 518. Consequently, the feed roller 510 is connected to the drive shaft 511 and the first bracket 513*a*. Conversely, the user may apply a force to the knobs 518 of the feed roller 518 connected to the drive shaft 511 and the first bracket 513*a* so as to push the subsidiary shaft 517 into the main shaft 515, so that the feed roller 510 is easily removed from the drive shaft 511 and the first bracket 513*a*.

(Pad Assembly)

Figure 6:
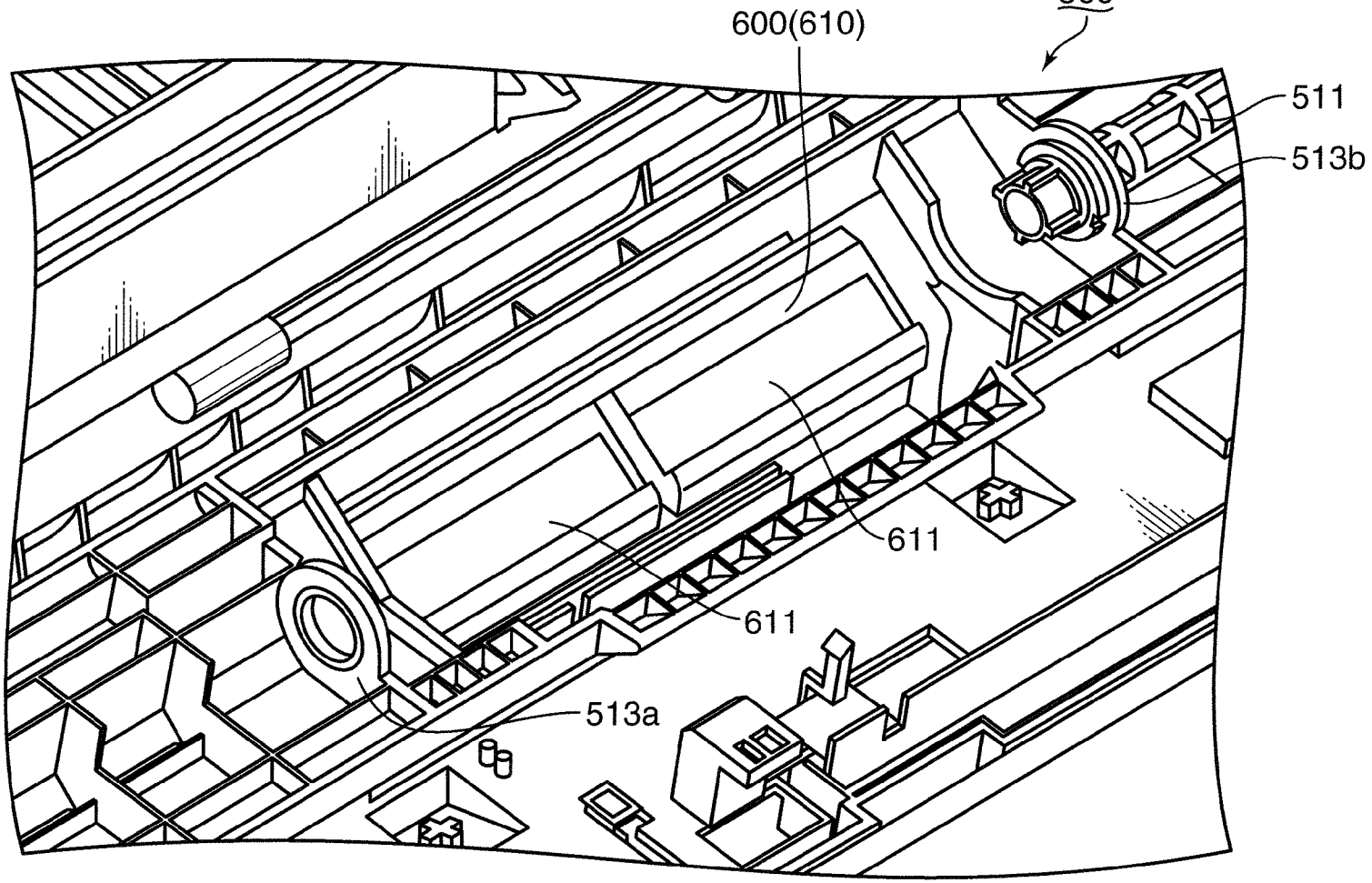
FIG. 6 is a perspective view of the feed assembly after removal of the feed roller shown in FIG. 5.

FIG. 6 is a perspective view of the feed assembly 500 after removal of the feed roller 510. The feed assembly 500 is further described with reference to FIG. 1 and FIGS. 4 to 6.

The feed assembly 500 further includes a pad assembly 600. When the feed roller 510 is removed from the drive shaft 511 and the first bracket 513*a* according to the steps described in the context of FIG. 5, a pad 610 of the pad assembly 600 below the feed roller 510 appears.

As described above, the user may place a pile of sheets onto the tray 212. The feed assembly 500 successively sends a sheet of the sheet pile into the lower housing 21. In the present embodiment, one sheet of the sheet pile is exemplified as a first sheet. A sheet following the first sheet is exemplified as a second sheet. In the following description, the term "sheet" may mean the first sheet and/or the second sheet. The term "second sheet" does not only mean a sheet conveyed immediately after a "first sheet". Other sheets may be present between the "first sheet" and the "second sheet". The pad assembly 600 separates the second sheet from the first sheet when the feed roller 510 conveys the first sheet and the second sheet overlapped with the first sheet. The pad assembly 600 is exemplified as a separating mechanism.

The pad 610 causes a resistance force (frictional force) against the conveyance of the sheet by the feed roller 510 when the feed roller 510 conveys the first sheet and the second sheet overlapped with the first sheet. Consequently, the second sheet is suitably separated from the first sheet. In the present embodiment, the pad 610 is exemplified as a separator.

The pad 610 includes a substantially rectangular pad plate 611. The pad plate 611 and the feed roller 510 sandwiches a sheet. The pad plate 611 forms a frictional surface configured to cause the frictional force on the sheet. A first sheet in direct contact with the feed roller 510 is fed into the lower housing 21 (see FIG. 1) by the feed roller 510. On the other hand, the frictional surface formed on the pad plate 611 applies the friction force against the conveyance of a second sheet overlapped with the first sheet. Therefore, the pad assembly 600 may appropriately separate the second sheet from the first sheet.

The pad 610 which has been pressed by the feed roller 510 is pushed upwards by a first biasing element (not shown in FIG. 6), which is disposed inside the pad assembly 600, after the feed roller 510 is removed. A user may easily grip the pushed pad to remove the pad assembly 600 and install a new pad assembly 600 to the feed assembly 500.

Figure 7:
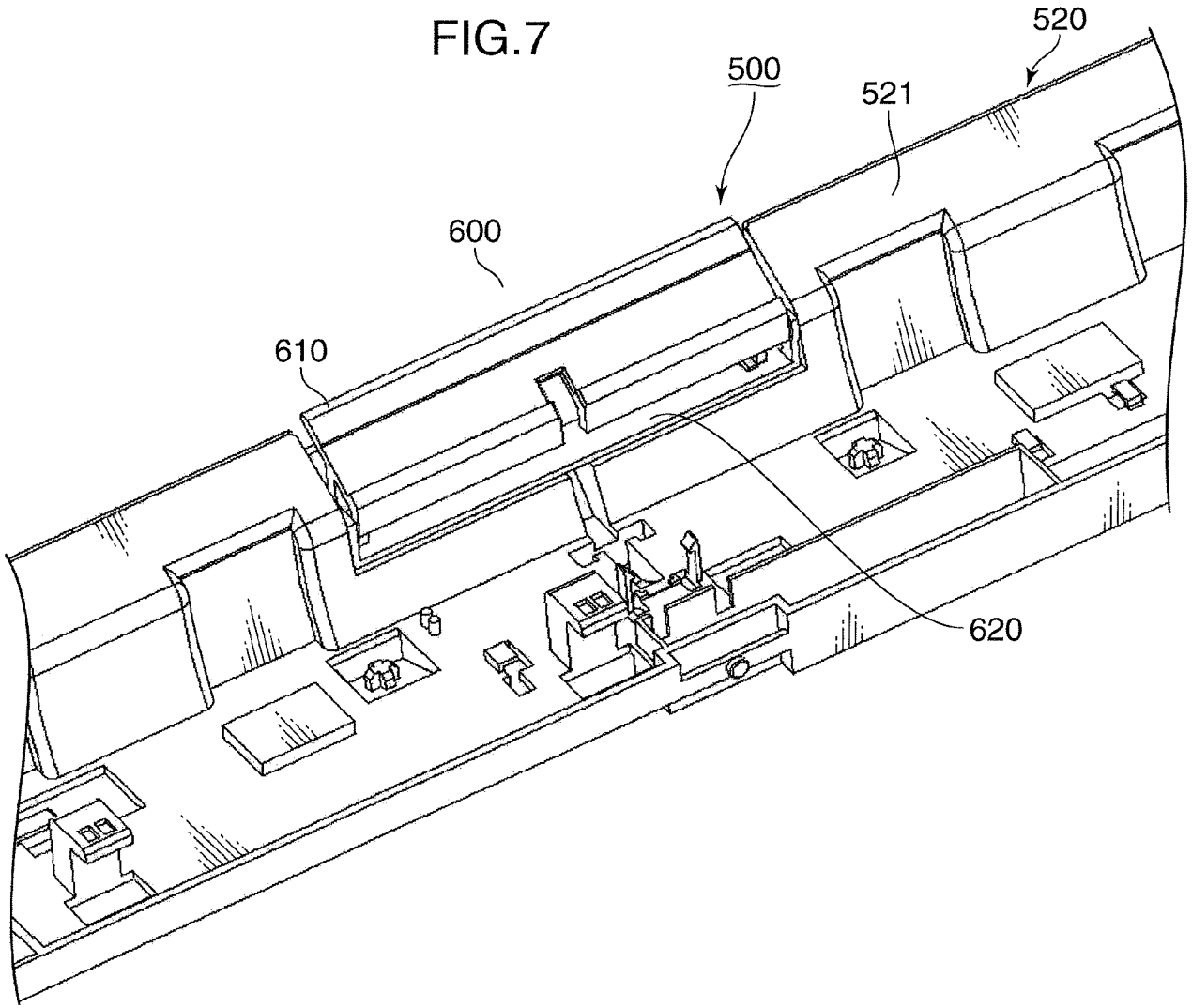
FIG. 7 is a perspective view showing a pad assembly with a pad pushed out from a guide surface.

FIG. 7 is an enlarged perspective view of the feed assembly 500. The feed assembly 500 is further described hereinafter with reference to FIGS. 4 to 7.

The feed assembly 500 further comprises a base 520 including a guide surface 521 configured to guide a sheet. The rotating feed roller 510 contacts and conveys a sheet on the guide surface 521. The first bracket 513*a* and the second bracket 513*b* to support the feed roller 510 and the drive shaft 511 are provided above the guide surface 521. The base 520 supports the feed roller 510 and the drive shaft 511 via the first bracket 513*a* and the second bracket 513*b*.

The pad assembly 600 includes the pad 610 and a seat 620 configured to accommodate the pad 610. When the feed roller 510 is installed, the pad 610 is pushed into the seat 620. An upper surface of the pad 610 pushed into the seat 620 is substantially flush with the guide surface 521. The feed roller 510 and the upper surface of the pad 610 grip a sheet, which is located between the guide surface 521 and the feed roller 510. When the feed roller 510 feeds a first sheet and a second sheet overlapped with the first sheet, as described above, the pad 610 applies the frictional force to the second sheet (the lowermost sheet among the conveyed sheets). Consequently, the sheets except for the first sheet (the uppermost sheet among the conveyed sheet) are less likely to be conveyed downstream.

Figure 8:
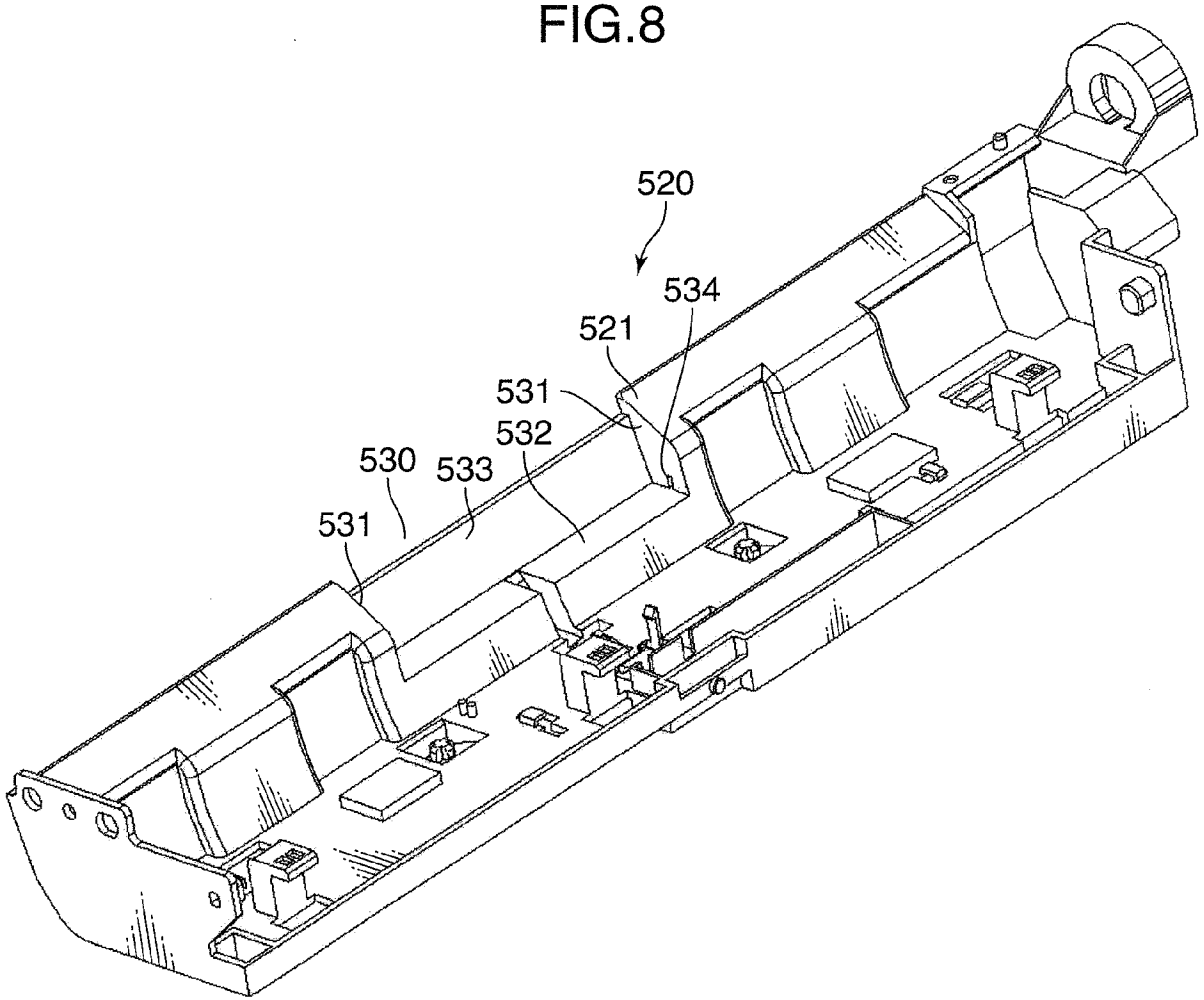
FIG. 8 is a perspective view showing a base after removal of the pad assembly shown in FIG. 7.
Figure 9:
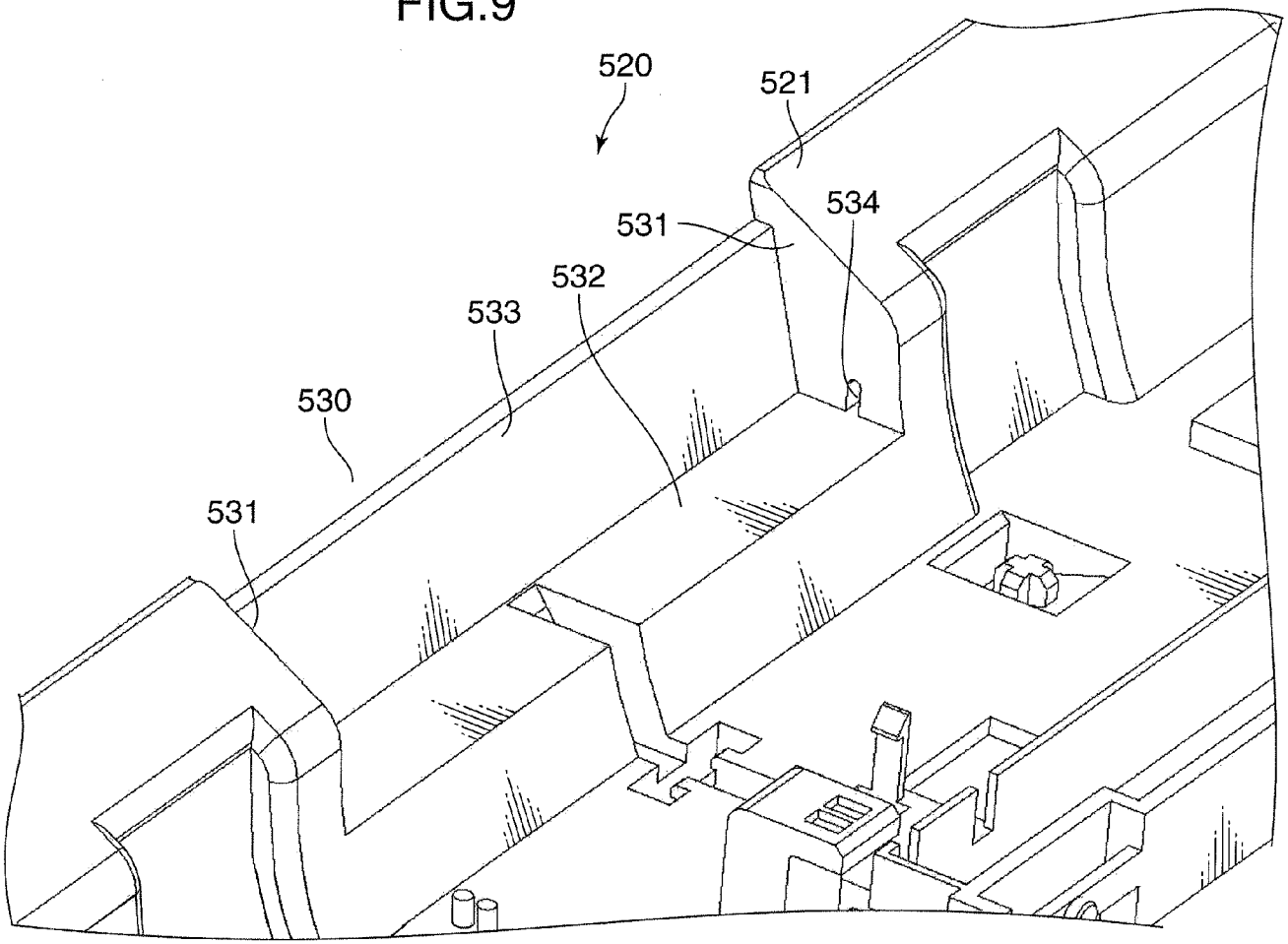
FIG. 9 is an enlarged perspective view of a reception recess formed in the base shown in FIG. 8.
Figure 10:
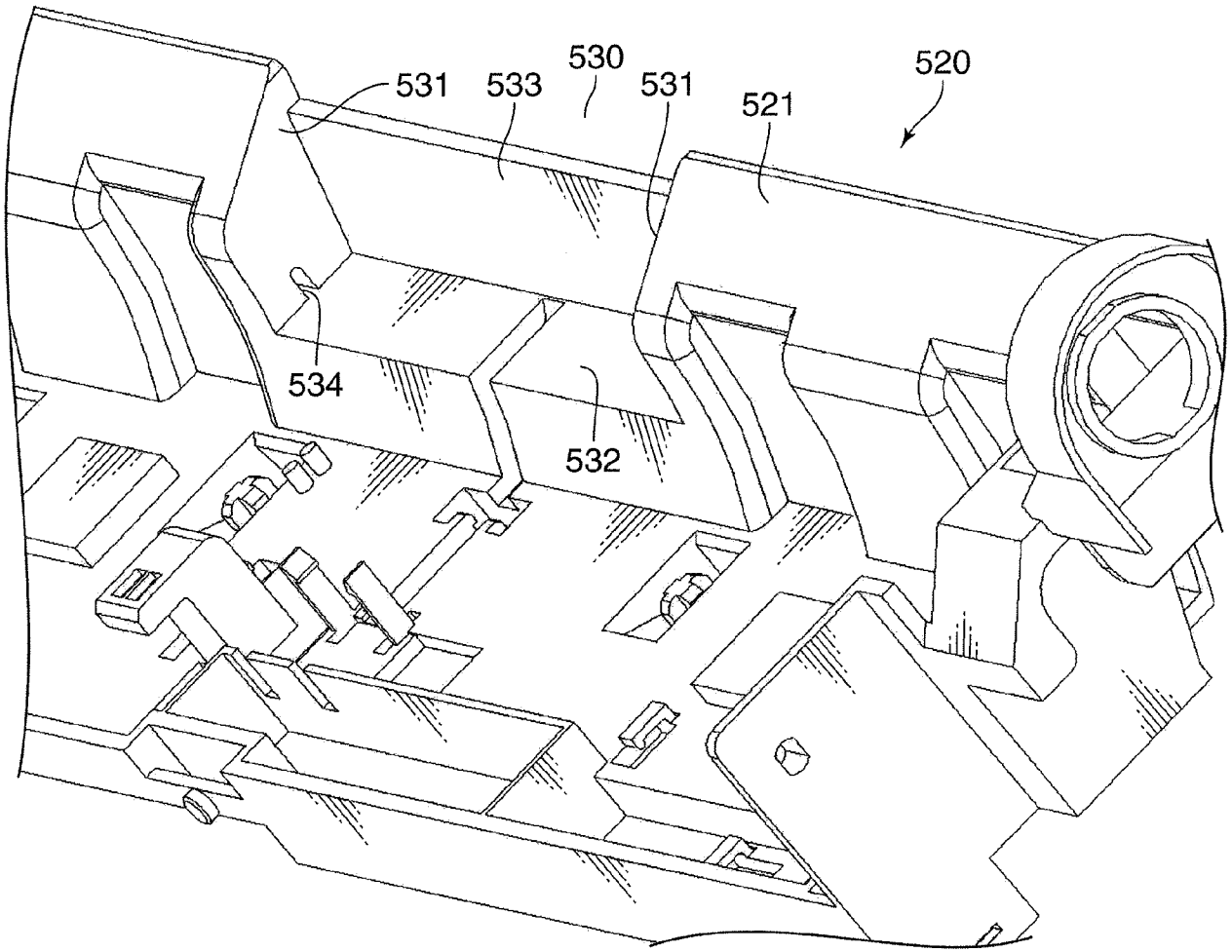
FIG. 10 is an enlarged perspective view of the reception recess formed in the base shown in FIG. 8.

FIG. 8 is a perspective view of the base 520. FIGS. 9 and 10 are enlarged perspective views of a reception recess formed in the base 520. The base 520 is described hereinafter with reference to FIGS. 7 to 10.

A reception recess 530 configured to accommodate the pad assembly 600 is provided in the guide surface 521 of the base 520. The base 520 comprises a pair of positioning walls 531 perpendicularly extending downwards from the guide surface 521, a bottom wall 532 extending along lower edges of the paired positioning walls 531, and a downstream wall 533 extending between the paired positioning walls 531 along a downstream edge of the bottom wall 532. The reception recess 530 is partially surrounded by the paired positioning walls 531, the bottom wall 532 and the downstream wall 533. An engaging portion 534 for engaging with a pin, which is exemplified as a positioning element of the pad assembly 600 described hereinafter, is formed on at least one of the paired positioning walls 531. The engaging portion 534 shown in FIG. 8 is an arched through hole which extends through the positioning wall 531. Alternatively, the engaging portion 534 may be a groove, a recess or another structure or shape configured to engage with the positioning element.

Figure 11:
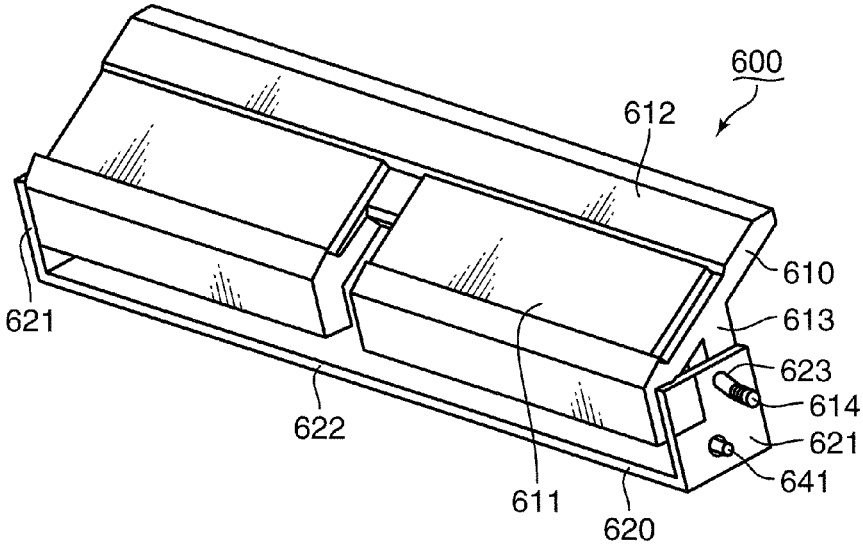
FIG. 11 is a perspective view of the pad assembly shown in FIG. 7.
Figure 12:
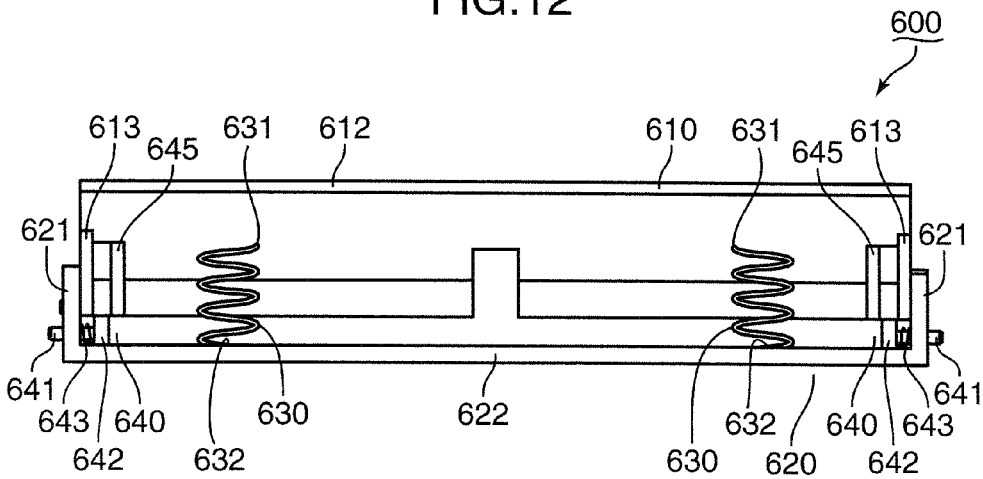
FIG. 12 is a rear view of the pad assembly shown in FIG. 11.

FIG. 11 is a perspective view of the pad assembly 600. FIG. 12 is a rear view of the pad assembly 600. The pad assembly 600 is described hereinafter with reference to FIGS. 8, 11 and 12.

As described above, the pad assembly 600 comprises the pad 610 and the seat 620 configured to accommodate the pad 610. The seat 620 includes a pair of first walls 621 which confront the paired positioning walls 531, respectively, and a second wall 622 extending between lower edges of the paired first walls 621. The second wall 622 of the seat 620 accommodated in the reception recess 530 is supported by the bottom wall 532 which forms the reception recess 530. A slit 623 is formed in each of the first walls 621. The slit 623 extends in a perpendicular direction (oblique downward direction) with respect to the pad plate 611 of the pad 610.

The pad 610 includes the aforementioned pad plate 611, a substantially L-shaped supporting plate 612 configured to support the pad plate 611, and side walls 613 extending from side edges of the supporting plate 612 toward the second wall 622. While the feed roller 510 is supported by the drive shaft 511 and the first bracket 513*a*, the pad 610 is accommodated in the reception recess 530. Meanwhile, upper surfaces of the pad plate 611 and the supporting plate 612 partially form the guide surface 521 for guiding a sheet. Guide pins 614 inserted into the slits 623 are attached in the side walls 613.

The pad assembly 600 comprises a pair of first biasing elements 630 each of which includes a first end 631 connected with a lower surface of the supporting plate 612 and a second end 632 opposite to the first end 631. The second end 632 is connected to an upper surface of the second wall 622. The first biasing elements 630 bias the pad 610 in a direction away from the second wall 622. The pad 610 moves upward (i.e. a direction whereby the pad 610 projects from the guide surface 521) along the slits 627 which guide the pad 610 because the guide pins 614 are inserted into the slits 627, respectively, as soon as the feed roller is removed. The engagement between the guide pins 614 and the slits 623 defines an upper limit of upward movement of the pad 610. The guide pins 614 are stopped at upper ends of the slits 623 when the pad 610 moves upward. Consequently, the pad 610 is less likely to completely separate from the seat 620. The first walls 621 extend in a bias direction of the first biasing elements 630. In the present embodiment, a coil spring is exemplified as the first biasing element 630. Alternatively, any member or element configured to bias and push out the pad 610 from the seat 620 may be used as the first biasing element 630. In the present embodiment, the pad 610 may comprise support shafts projecting from side surfaces of the pad 610. The support shafts may be, for example, inserted into recesses or through holes formed in the first walls 621, respectively (not shown). The pad 610 biased by the first biasing elements 630 may be rotate around the support shafts within a range defined by the slits 623.

The pad assembly 600 further comprises a shifter 640. The shifter 640 is used to fix a position of the pad assembly 600 inside the reception recess 530 and to release the pad assembly 600 from the fixed position.

Figure 13B:
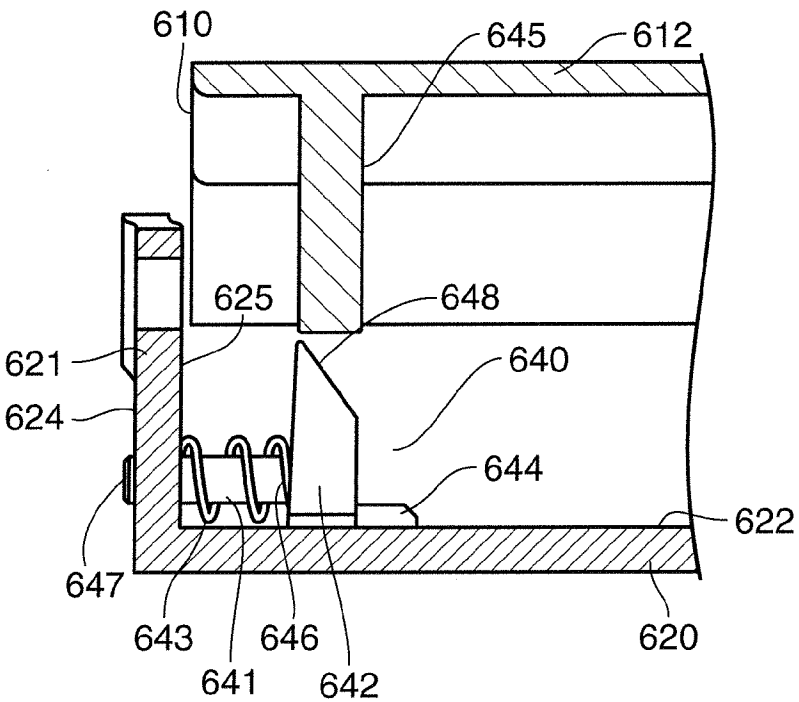
FIG. 13B is a schematic view showing the operation of the pad assembly shown in FIG. 12.
Figure 13A:
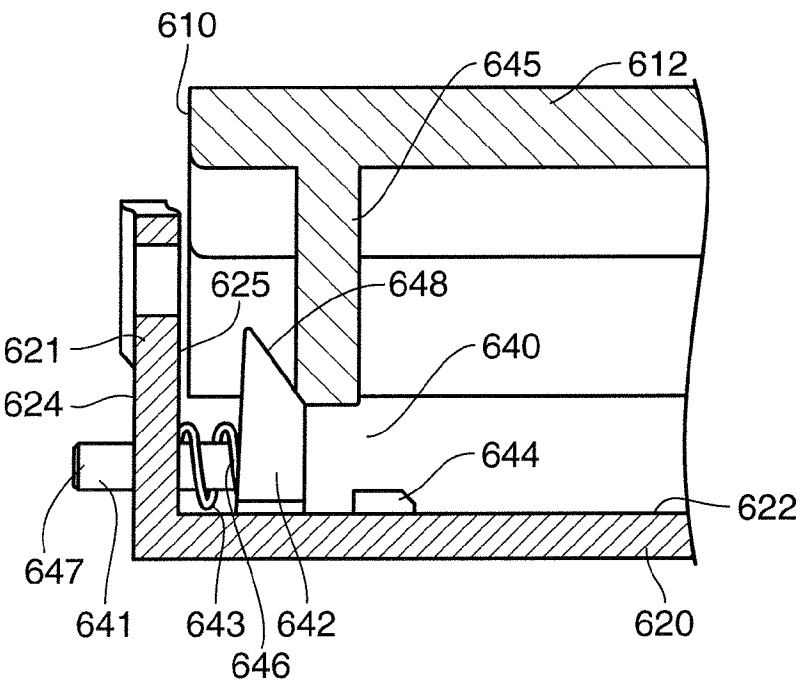
FIG. 13A is a schematic view showing operation of the pad assembly shown in FIG. 12.
Figure 14:
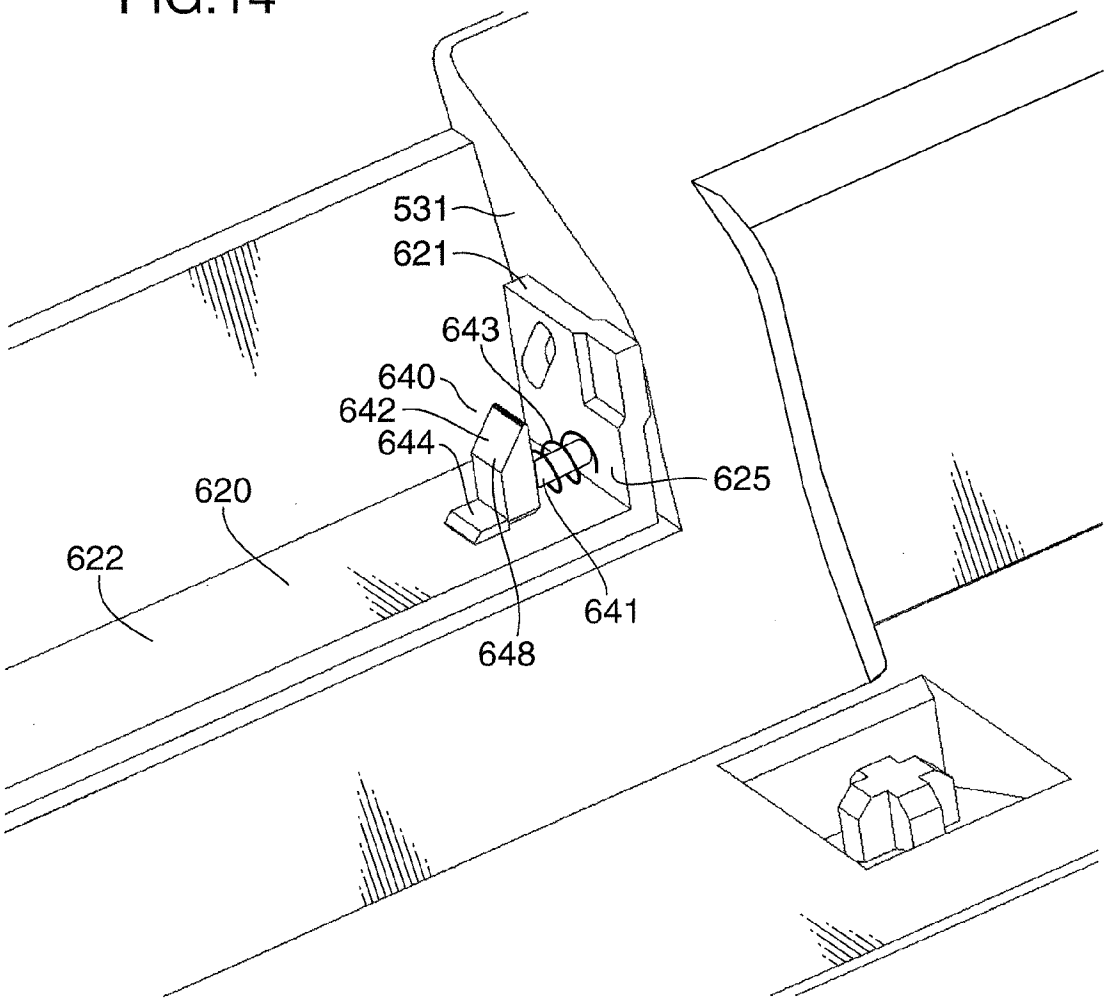
FIG. 14 is a perspective view partially showing a shifter of the pad assembly shown in FIG. 12.

FIGS. 13A and 13B are cross-sectional views showing a pin 641 and the shifter 640. FIG. 13A shows the pin 641 located in a first position. FIG. 13B shows the pin 641 located in a second position. FIG. 14 is a perspective view showing the pin 641 and the shifter 640 appearing after removal of the pad 610. The pin 641 and the shifter 640 are described hereinafter with reference to FIGS. 13A to 14.

As described above, the pad assembly 600 comprises the pin 641 inserted into a through hole formed in the first wall 621. The pin 641 mounted on the first wall 621 moves between the first position where the pin 641 is engaged with the engaging portion 534 and the second position where the pin 641 is disengaged from the engaging portion 534. In the present embodiment, the pin 641 is exemplified as a positioning element. Alternatively, another structure, shape or element configured to selectively achieve engagement with the engaging portion 534 and disengagement from the engaging portion 534 may be used as the positioning element.

The first wall 621 includes a first surface 624 confronting the positioning wall 531 and a second surface 625 opposite to the first surface 624. The pin 641 includes a base end 646 beside the second surface 625 and a tip end 647 opposite to the base end 646. The engaging portion 534 formed in the positioning wall 531 is configured to accommodate the tip end 647 of the pin 641.

The shifter 640 comprises a wedge block 642 connected to the base end 646 of the pin 641 in the seat 620, and a second biasing element 643 wound around the pin 641 between the second surface 625 of the first wall 621 and the wedge block 642. In the first position, the tip end 647 of the pin 641 projects beyond the first surface 624 of the first wall 621 and is inserted into the engaging portion 534 formed in the positioning wall 531. Due to the engagement between the pin 641 and the engaging portion 534, the seat 620 is fixed in position inside the reception recess 530. The second biasing elements 643 bias the pins 641, which are connected to the wedge blocks 642, toward the medial of the seat 620 (i.e. toward the second position). In the present embodiment, a coil spring is exemplified as the second biasing element 643. Alternatively, any member configured to bias the wedge block 642 toward the medial of the seat 620 may be used as the second biasing element 643.

The shifter 640 further comprises a projection 644 projecting from an upper surface of the second wall 622 of the seat 620 in a movement path of the wedge block 642, which is defined by insertion of the pin 641 into the first wall 621. The movement of the wedge block 642 from the first position to the second position is halted by the projection 644. Thus, the projection 644 fixes a position of the wedge block 642 at the second position. The pin 641 moves into the seat 620, which results in disengagement between the pin 641 and the engaging portion 534, while the wedge block 642 reaches the second position.

An upper surface 648 of the wedge block 642 is inclined downward toward the medial of the seat 620. The shifter 640 includes a rib 645 extending from the lower surface of the supporting plate 612 toward the second wall 622. In the present embodiment, the rib 645 is exemplified as a projection projecting toward the second wall 622 from the pad 610, which is exemplified as a separator.

The rib 645 is disposed above the wedge block 642 located in the second position. As aforementioned, when the feed roller 510 is attached to the drive shaft 511, the pad 610 is pushed and displaced downward into the seat 620 (i.e. the rib 645 approaches the second wall 622). Consequently a lower end of the rib 645 presses against the upper surface 648 of the wedge block 642. Due to the contact between the rib 645 and the upper surface of the wedge block 642, the wedge block 642 and the pin 641 move toward the first wall 621 (in a direction opposite to the bias direction of the second biasing element 643), and arrive at the first position. Consequently, while the feed roller 510 attached to the drive shaft 511 keeps the pad 610 inside the seat 620, the rib 645 holds the pin 641 in the first position. Thus, the pad assembly 600 is suitably positioned inside the reception recess 530. On the other hand, when the feed roller 510 is removed from the drive shaft 511, the first biasing elements 630 push the pad 610 upward. Furthermore, the second biasing element 643 moves the wedge block 642 to the medial of the seat 620 so that the pin 641 is moved to the second position. In the present embodiment, the inclined upper surface 648 of the wedge block 642 is exemplified as a contact surface configured to contact the rib 645. Alternatively, the wedge block 642 may include a different contact surface in shape as long as contact between the contact surface and the rib causes movement of the pin 641 to the first position.

In the present embodiment, for example, a rail configured to guide the wedge block 642 may be formed on the second wall 622 of the seat 620. The second wall 622 may includes a thinner portion for formation of the rail which primarily guides the wedge block 642. As a result of stable guidance of the wedge block 642 by the rail, the pin is suitably engaged with the engaging portion 534.

As described above, the pad 610 automatically projects from the guide surface 521 after removal of the feed roller 510. Therefore, even a general user, who is less experienced, may intuitively notice that the pad 610 is a part to be replaced. The user may, therefore, more easily replace the pad assembly 600.

(Second Embodiment)

Figure 15:
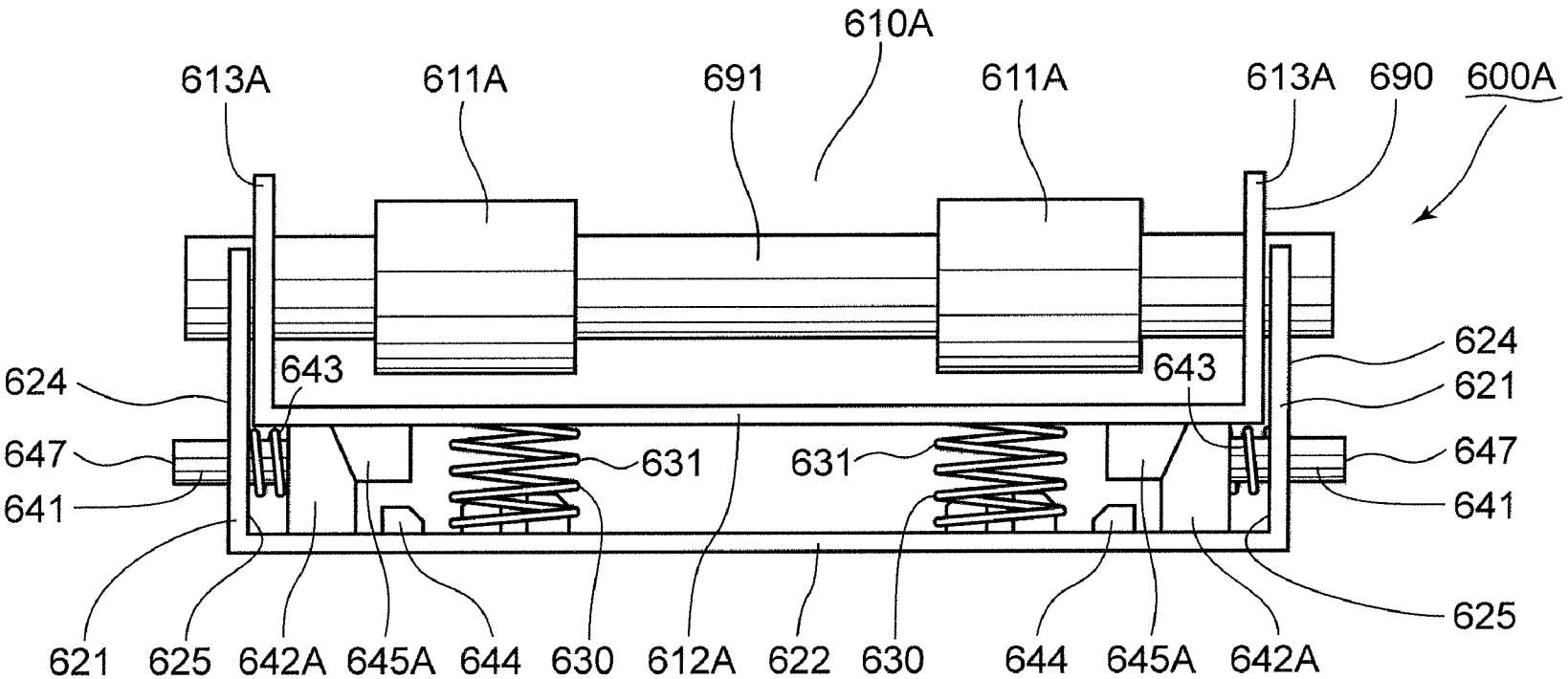
FIG. 15 is a schematic view of a separating roller mechanism used in a feed assembly according to the second embodiment.

FIG. 15 shows a schematic view of a separating roller mechanism 600A used for a feed assembly and a copying machine, which is exemplified as an image forming apparatus, according to a second embodiment. In the drawings described below, elements similar to those of the first embodiment are labeled with the same reference numerals. Different features between the first embodiment and the second embodiment are described below. In the present embodiment, the separating roller mechanism 600A is exemplified as a separating mechanism.

The separating roller mechanism 600A includes a roller unit 610A. In the present embodiment, the roller unit 610A is exemplified as a separator configured to cause a resisting force against conveyance of a sheet by a feed roller 510 and thereby separation between a first sheet and a second sheet which is conveyed and overlapped with the first sheet. The structure of the feed roller 510 may be the same as that of the first embodiment.

The roller unit 610A comprises a supporting holder 690 including a supporting plate 612A to which first ends 631 of first biasing elements 630 are connected and third walls 613A which extend upwards from left and right edges of the supporting plate 612A. Similarly to the first embodiment, a guide pin 614 (not shown in FIG. 15) may be mounted on the third wall 613 adjacent to second surface 625 of first wall 621. Similarly to the first embodiment, the guide pin 614 may be inserted into a slit 623 (not shown in FIG. 15) formed in the first wall 621. In terms of these features, the third walls 613A correspond to the side walls 613 of the pad 610 shown in the first embodiment.

The roller unit 610A also comprises a supporting shaft 691 which is supported by the third walls 613A, and a pair of substantially cylindrical separating rollers 611A rotatably mounted on the supporting shaft 691. The separating rollers 611A and the feed roller 510 sandwich a sheet. Since the separating rollers 611A configured to cause a resisting force on the sheets rotate, preferably, the separating rollers 611A is less likely to be locally worn out. Consequently, a life of the separating rollers 611 is likely to be extended.

The separating rollers 611A are equipped with an internal resistance element (not illustrated) configured to increase rotational resistance of the separating rollers 611A, respectively. A torque limiter or a one-way clutch may be suitably used as the resistance element. Consequently the separating roller 611A causes a frictional force on a second sheet, which is conveyed and overlapped with a first sheet, to suitably separate the second sheet from the first sheet.

Ribs 645A, which look like a substantially right trapezoid column, project from a lower surface of a supporting plate 612A toward a second wall 622. The rib 645A is exemplified as a projection, similarly to the rib 645 described in the context of the first embodiment. An inclined surface of each rib 645A confronts a wedge block 642A. The wedge blocks 642A are substantially pentagonal column-shaped block bodies formed by partially cutting a rectangular parallelepiped block along a line linking a center line of an upper surface with a center line of a vertical surface. The inclined surfaces of the wedge blocks 642A are exemplified as contact surfaces, which make contact with the inclined surfaces of the ribs 645A.

Figure 16B:
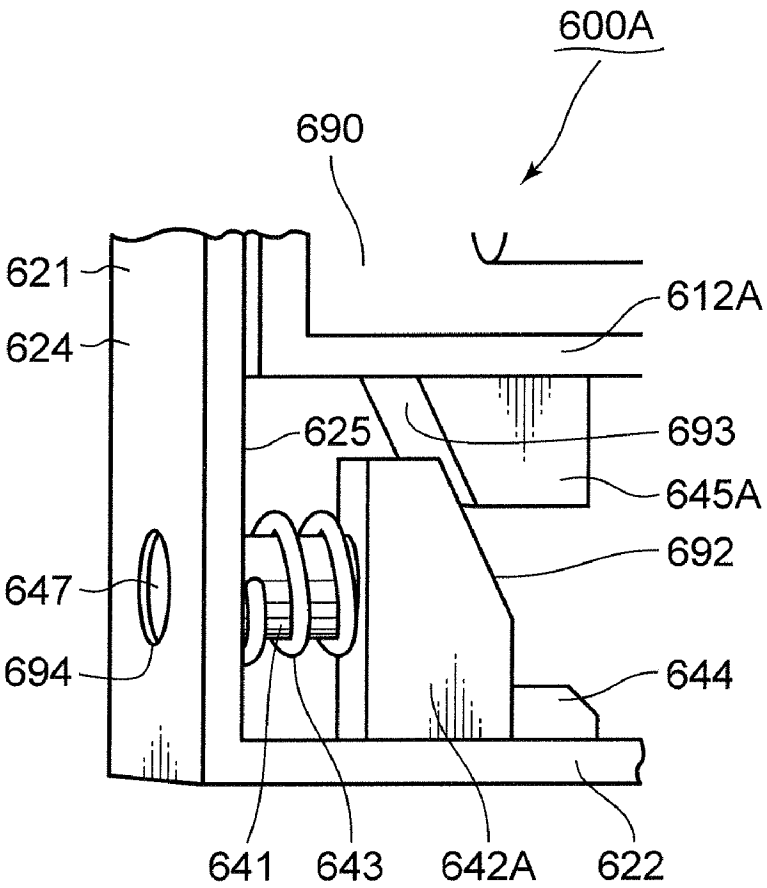
FIG. 16B is a schematic view showing the operation of the separating roller mechanism shown in FIG. 15.
Figure 16A:
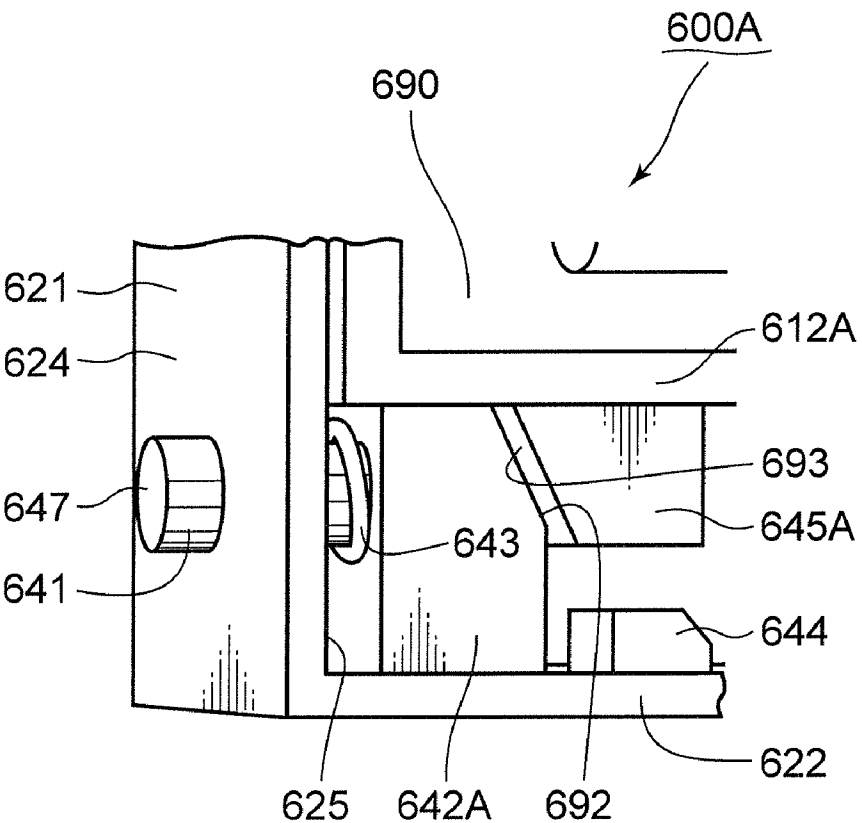
FIG. 16A is a schematic view showing operation of the separating roller mechanism shown in FIG. 15.

FIG. 16A and FIG. 16B are enlarged views of a pin 641 connected to the wedge block 642A. FIG. 16A shows the pin 641 located in a first position. FIG. 16B shows the pin 641 located in a second position. The separating roller mechanism 600A is further described hereinafter with respect to FIGS. 15 to 16B.

The pin 641 is moved toward the first position by the contact between the inclined surface 692 of the wedge block 642A and the inclined surface 693 of the rib 645A approaching the second wall 622. When the upper surface of the wedge block 642A abuts against a lower surface of the supporting plate 612A, the pin 641 reaches the first position. A tip end 647 of the pin 641 reached the first position projects from a first surface 624 of a first wall 621. The tip end 647 of the pin 641 in the first position is inserted into an engaging portion 534 formed in a base 520. In the present embodiment, the base 520 and the engaging portion 534 are similar to the first embodiment.

When the feed roller 510 is removed, the second biasing elements 643, which have been compressed between the wedge blocks 642A connected to pins 641 in the first position and the second surfaces 625 of the first walls 621, respectively, stretch and move the wedge blocks 642A toward the projections 644. When the wedge blocks 642A moving along an upper surface of the second walls 622 make contact with projections 644, the pins 641 arrive at the second position. The tip ends 647 of the pins 641 in the second position are buried inside through holes 694 formed in the first walls 621.

The engagement between the slits 623 formed in the first walls 621 (not shown in FIGS. 16A and 16B) and the guide pins 614 (not shown in FIGS. 16A and 16B) restricts the upward movement of the supporting holder 690, similarly to the first embodiment. When the pins 641 reach the second position, the upward movement of the supporting holder 690 is halted. Consequently a lower portion of the inclined surface 693 of the rib 645A projecting from the supporting plate 612A keeps contact with an upper portion of the inclined surface 692 of the wedge block 642A connected to the pin 641 in the second position. Therefore, when the feed roller 510 is installed, the wedge blocks 642A are pushed out toward the second surfaces 625 of the first walls 621 by the inclined surfaces 693 of the ribs 645A approaching the second walls 622. Thus, the pins 641 are moved to the first position.

Figure 17:
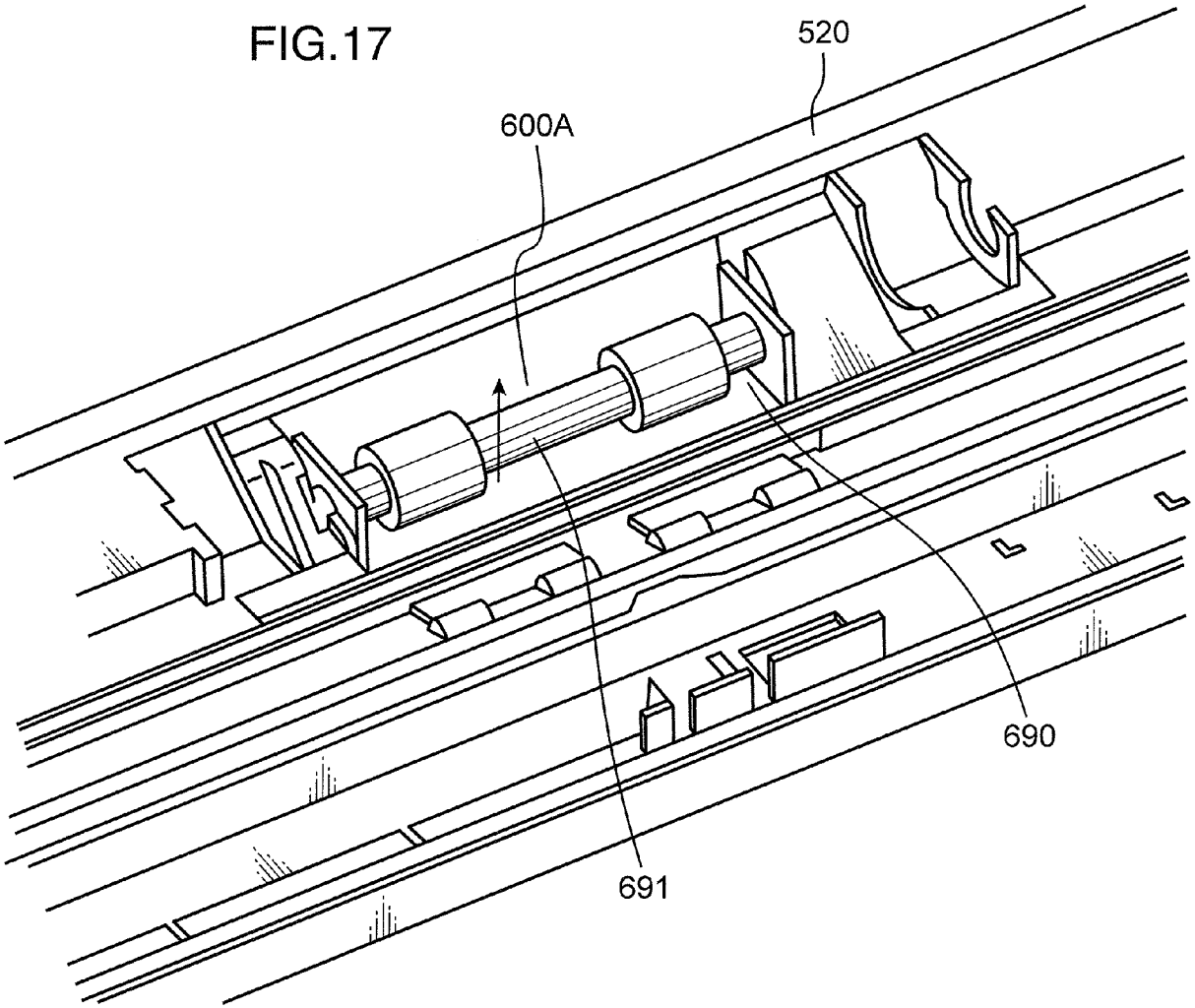
FIG. 17 is a schematic perspective view of a base after installation of the separating roller mechanism shown in FIG. 15.

FIG. 17 is a perspective view showing the separating roller mechanism 600A installed on the base 520. The separating roller mechanism 600A is further described with reference to FIGS. 3, 15 and 16.

When the feed roller 510 is removed, the supporting holder 690 is pushed upward by the first biasing elements 630. Consequently a user may intuitively recognize the supporting holder 690 as a component to be replaced. The user may easily grip and pull up the supporting shaft 691 supported on the pushed supporting holder 690 in order to remove the separating roller mechanism 600A.

The separating rollers 611A press against the feed roller 510 when the feed roller 510 is installed on the base 520 as shown in FIG. 3 after installation of a new separating roller mechanism 600A on the base 520. Consequently the supporting holder 690 moves downward. Therefore, the pins 641 move to the first position and the new separating roller mechanism 600A becomes securely connected with the base 520.

This application is based on Japanese Patent application serial Nos. 2009-291094 and 2010-119669 filed in Japan Patent Office on Dec. 22, 2009 and May 25, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A feed assembly for feeding a sheet including a first sheet and a second sheet following the first sheet comprising:

a feed roller configured to convey the sheet;

a support element configured to detachably and rotatably support the feed roller;

a separating mechanism configured to separate the second sheet from the first sheet when the second sheet is conveyed and overlapped with the first sheet; and a base including a guide surface configured to guide the sheet and a positioning wall configured to position the separating mechanism; wherein an engaging portion configured to engage with the separating mechanism is formed in the positioning wall; and the separating mechanism includes:

a separator configured to cause a resistance force against conveyance of the sheet by the feed roller to separate the second sheet from the first sheet when the second sheet is conveyed and overlapped with the first sheet;

a first biasing element including a first end connected to the separator and a second end opposite to the first end;

a seat including a first wall confronting the positioning wall and a second wall connected to the second end of the first biasing element;

a positioning element installed on the first wall so that the positioning element moves between a first position where the positioning element is engaged with the engaging portion and a second position where the positioning element is disengaged from the engaging portion; and a shifter configured to shift the positioning element between the first position and the second position;

the first biasing element biases the separator apart from the second wall;

the shifter holds the positioning element in the first position while the support element supports the feed roller; and when the feed roller is removed from the support element, the first biasing element projects the separator from the guide surface while the shifter shifts the positioning element to the second position.

2. The feed assembly according to claim 1, wherein the first wall includes a first surface confronting the positioning wall and a second surface opposite to the first surface;

the positioning element includes a pin with a base end beside the second surface;

the shifter includes:

a wedge block connected to the base end of the pin;

a second biasing element disposed between the wedge block and the second surface and configured to biase the pin toward the second position; and a projection projecting from the separator toward the second wall;

the wedge block includes a contact surface configured to contact the projection; and the projection approaching the second wall when the feed roller is installed on the support element presses against the contact surface, so that the pin is moved to the first position.

3. The feed assembly according to claim 2, wherein the shifter further includes a rail formed on the second wall; and the rail guides movement of the wedge block.

4. The feed assembly according to claim 2, wherein:

the positioning wall defines a reception recess in the guide surface;

the seat is received in the reception recess;

the separator is received in the reception recess while the support element supports the feed roller;

the pin includes a tip end opposite to the base end; and the engaging portion accommodates the tip end of the pin in the first position.

5. The feed assembly according to claim 1, wherein a slit configured to limit a movement range of the separator in a projecting direction from the guide surface is formed in the first wall;

the separator includes a guide pin inserted into the slit; and the guide pin moves along the slit when the first biasing element projects the separator from the guide surface.

6. The feed assembly according to claim 1, wherein the separator includes:

a pad plate forming a frictional surface configured to cause a frictional force on the sheet; and a supporting plate configured to support the pad plate.

7. The feed assembly according to claim 1, wherein the separator includes:

a separating roller configured to nip the sheet in coordination with the feed roller; and a supporting shaft configured to rotatably support the separating roller; and the separating roller causes a frictional force on the sheet.

8. An image forming apparatus for forming an image on a sheet including a first sheet and a second sheet following the first sheet, the image forming apparatus comprising:

a feed assembly configured to feed the sheet; and an image forming portion configured to form the image on the sheet conveyed from the feed assembly; wherein the feed assembly includes:

a feed roller configured to convey the sheet;

a support element configured to detachably and rotatably support the feed roller;

a separating mechanism configured to separate the second sheet from the first sheet when the second sheet is conveyed and overlapped with the first sheet; and a base including a guide surface configured to guide the sheet and a positioning wall configured to position the separating mechanism;

an engaging portion configured to engage with the separating mechanism is formed in the positioning wall;

the separating mechanism includes:

a separator configured to cause a resistance force against conveyance of the sheet by the feed roller to separate the second sheet from the first sheet when the second sheet is conveyed and overlapped with the first sheet;

a first biasing element including a first end connected to the separator and a second end opposite to the first end;

a seat including a first wall confronting the positioning wall and a second wall connected to the second end of the first biasing element;

a positioning element installed on the first wall so that the positioning element moves between a first position where the positioning element is engaged with the engaging portion and a second position where the positioning element is disengaged from the engaging portion; and a shifter configured to shift the positioning element between the first position and the second position;

the first biasing element biases the separator apart from the second wall;

the shifter holds the positioning element in the first position while the support element supports the feed roller; and when the feed roller is removed from the support element, the first biasing element projects the separator from the guide surface while the shifter shifts the positioning element to the second position.

* * * * *